US011180715B2

(12) United States Patent
Keuleers et al.

(10) Patent No.: US 11,180,715 B2
(45) Date of Patent: Nov. 23, 2021

(54) SPRAYABLE CLEANING COMPOSITION

(71) Applicant: The Procter & Gamble Company, Cincinnati, OH (US)

(72) Inventors: Robby Renilde Francois Keuleers, Lippelo (BE); Roxane Rosmaninho, Auderghem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/010,808

(22) Filed: Jun. 18, 2018

(65) Prior Publication Data

US 2018/0371368 A1 Dec. 27, 2018

(30) Foreign Application Priority Data

Jun. 22, 2017 (EP) ..... 17177274
Jan. 24, 2018 (EP) ..... 18153246

(51) Int. Cl.

| | |
|---|---|
| ***C11D 1/29*** | (2006.01) |
| ***C11D 1/72*** | (2006.01) |
| ***C11D 1/75*** | (2006.01) |
| ***C11D 1/83*** | (2006.01) |
| ***C11D 3/43*** | (2006.01) |
| ***B08B 3/04*** | (2006.01) |
| ***C11D 3/20*** | (2006.01) |
| ***C11D 11/00*** | (2006.01) |
| ***C11D 17/04*** | (2006.01) |
| ***C11D 17/00*** | (2006.01) |
| ***C11D 1/831*** | (2006.01) |
| *C11D 1/14* | (2006.01) |

(52) U.S. Cl.

CPC ..... *C11D 3/2068* (2013.01); *C11D 1/83* (2013.01); *C11D 1/831* (2013.01); *C11D 3/43* (2013.01); *C11D 11/0005* (2013.01); *C11D 11/0023* (2013.01); *C11D 17/0043* (2013.01); *C11D 17/041* (2013.01); *C11D 1/146* (2013.01); *C11D 1/29* (2013.01); *C11D 1/72* (2013.01); *C11D 1/75* (2013.01)

(58) Field of Classification Search

CPC .... C11D 1/29; C11D 1/72; C11D 1/75; C11D 1/83; C11D 3/2068; C11D 3/3418; C11D 3/43; C11D 17/0043; C11D 17/041; B08B 3/04

See application file for complete search history.

(56) References Cited

U.S. PATENT DOCUMENTS

| | | | | |
|---|---|---|---|---|
| 4,670,171 | A | 6/1987 | Magyar | |
| 5,925,606 | A | 7/1999 | Stamm | |
| 6,057,279 | A | 5/2000 | Mertens | |
| 6,184,188 | B1 | 2/2001 | Severns | |
| 6,509,306 | B1 | 1/2003 | Wisniewski | |
| 6,683,036 | B2 | 1/2004 | Foley | |
| 6,696,399 | B1 | 2/2004 | Chernin | |
| 8,901,058 | B2 | 12/2014 | Evers | |
| 9,944,888 | B2 | 4/2018 | Gonzales | |
| 10,138,445 | B2 | 11/2018 | Boers | |
| 10,138,446 | B2 | 11/2018 | Boers | |
| 10,150,937 | B2 | 12/2018 | Boers | |
| 10,233,411 | B2 | 3/2019 | Hoefte | |
| 10,689,596 | B2 | 6/2020 | Boers | |
| 11,124,739 | B2 * | 9/2021 | Rosmaninho | C11D 1/123 |
| 2005/0233925 | A1 | 10/2005 | Foley | |
| 2009/0197790 | A1 | 8/2009 | Sengupta | |
| 2010/0197553 | A1 | 8/2010 | Barnabas | |
| 2011/0105377 | A1 * | 5/2011 | Yianakopoulos | C11D 1/72 510/365 |
| 2011/0180100 | A1 | 7/2011 | Hafer | |
| 2011/0226293 | A1 | 9/2011 | Bonnechere | |
| 2012/0102668 | A1 | 5/2012 | De | |
| 2015/0307817 | A1 | 10/2015 | Peitersen | |
| 2017/0015940 | A1 | 1/2017 | Boers | |
| 2017/0015946 | A1 | 1/2017 | Dkidak | |
| 2017/0015961 | A1 | 1/2017 | Boers | |
| 2017/0121655 | A1 | 5/2017 | Delplancke | |
| 2017/0137745 | A1 | 5/2017 | Tang | |
| 2017/0145357 | A1 | 5/2017 | Gonzales | |
| 2017/0145358 | A1 | 5/2017 | Delplancke | |
| 2018/0362900 | A1 | 12/2018 | Boers | |
| 2018/0369875 | A1 | 12/2018 | Debreczeni | |
| 2018/0371362 | A1 | 12/2018 | Keuleers | |
| 2018/0371363 | A1 | 12/2018 | Keuleers | |
| 2018/0371368 | A1 | 12/2018 | Keuleers | |

(Continued)

FOREIGN PATENT DOCUMENTS

| | | | |
|---|---|---|---|
| DE | 3004835 | A1 | 8/1981 |
| DE | 102006003336 | A1 | 7/2007 |

(Continued)

OTHER PUBLICATIONS

All Office Actions for U.S. Appl. No. 16/010,773.
All Office Actions for U.S. Appl. No. 16/010,788.
All Office Actions for U.S. Appl. No. 16/010,797.
European Search Report for Application No./Patent No. 17177274.2-1358, dated Dec. 4, 2017, 6 pages.
European Search Report for Application No./Patent No. 18153246.6-1106, dated May 2, 2018, 7 pages.
All Office Actions; U.S. Appl. No. 16/010,828.

(Continued)

*Primary Examiner* — Brian P Mruk

(74) *Attorney, Agent, or Firm* — Melissa Krasovec

(57) ABSTRACT

The present invention relates to a sprayable cleaning composition. More specifically, the present invention relates to a sprayable cleaning composition including a surfactant system, a non-ionic surfactant and a specific glycol ether solvent, wherein the surfactant system and the glycol ether solvent are in a weight ratio of from 5:1 to 1:5. The composition is substantially non-irritating and/or non-stinging when sprayed from a spray dispenser.

18 Claims, No Drawings

(56) References Cited

U.S. PATENT DOCUMENTS

| | | | |
|---|---|---|---|
| 2018/0371370 | A1 | 12/2018 | Keuleers |
| 2021/0230510 | A1 | 7/2021 | Rosmaninho et al. |

FOREIGN PATENT DOCUMENTS

| | | | | | |
|---|---|---|---|---|---|
| EP | 0316726 | A3 | | 10/1989 | |
| EP | 0368146 | A3 | | 8/1990 | |
| EP | 0616028 | A1 | | 9/1994 | |
| EP | 1101816 | A3 | | 8/2001 | |
| EP | 1167500 | A1 | | 1/2002 | |
| EP | 3118293 | A1 | | 1/2017 | |
| EP | 3118298 | | * | 1/2017 | ..... C11D 3/20 |
| EP | 3118298 | A1 | * | 1/2017 | ..... C11D 3/20 |
| EP | 3118301 | A1 | | 1/2017 | |
| EP | 3118295 | B1 | | 10/2018 | |
| EP | 3118298 | B1 | | 10/2018 | |
| EP | 3118299 | B1 | | 10/2018 | |
| EP | 3162881 | B1 | | 1/2019 | |
| JP | 2004161940 | A | | 6/2004 | |
| JP | 2011153233 | A | | 8/2011 | |
| JP | 2015145445 | A | | 8/2015 | |
| JP | 2017110157 | A | | 6/2017 | |
| WO | 9700930 | A1 | | 1/1997 | |
| WO | WO9715649 | A1 | | 5/1997 | |
| WO | WO9743375 | A1 | | 11/1997 | |
| WO | 9919441 | A1 | | 4/1999 | |
| WO | WO0155497 | A1 | | 8/2001 | |
| WO | WO03027218 | A1 | | 4/2003 | |
| WO | WO2004020565 | A1 | | 3/2004 | |
| WO | 2007082685 | A1 | | 7/2007 | |
| WO | WO2007095999 | A1 | | 8/2007 | |
| WO | 2008036559 | A2 | | 3/2008 | |

OTHER PUBLICATIONS

All Office Actions; U.S. Appl. No. 17/226,567.

PCT Search Report and Written Opinion for PCT/US2018/038003; dated Jul. 27, 2018, 10 pages.

* cited by examiner

SPRAYABLE CLEANING COMPOSITION

FIELD OF INVENTION

The present invention relates to a sprayable cleaning composition. In particular, it relates to a sprayable cleaning composition comprising a surfactant system, a non-ionic surfactant and a specific glycol ether solvent, wherein the surfactant system and the glycol ether solvent are in a weight ratio of from 5:1 to 1:5. Preferably, the composition is substantially non-stinging and/or non-irritating to the consumer when sprayed from a spray dispenser.

BACKGROUND OF THE INVENTION

Conventional hand dishwashing is typically performed by adding detergent to a water bath in a full sink and soaking/scrubbing the dishware in the detergent water bath. It has been found that a more efficient hand dishwashing method desired by consumers is to manually clean dishware as soon as they have finished with them rather than wait until they have a full load. This method involves washing one article or a small number of articles at a time. This type of washing method is usually performed under running water with a cleaning implement (e.g., sponge). The cleaning should be fast and involve minimum effort from the consumer.

A challenge with this approach is that the level and type of soils found on dishware varies considerably depending on the use of the dishware. As a result, there is a high risk for overdosing since enough of the product has to be used to ensure sufficient cleaning of the most hard to remove soiled (e.g., baked-, cooked- and/or burnt-on soils) dishware, which will then require more time for rinsing of the dishware and the cleaning implement. Another challenge associated with this approach is that time is needed to allow for appropriate mixing of the detergent with water and the sponge, thereby slowing down the cleaning process.

Finding more efficient ways of cleaning dishware with this approach is desirable. One such approach for quicker cleaning is direct application of spray dishwashing detergent onto the soiled dishware. Spray products are well liked by consumers since they allow for direct and controlled application of the products during the dishwashing process to mitigate against the challenges mentioned above. However, a notable problem with spray dishwashing detergent is product bounce back from surfaces when spraying, which can lead to irritation/stinging to the skin, eyes, nose and/or throat of the consumers. Another problem with spray dishwashing detergent is product overspray. By "overspray" means small particles spreading to the surrounding atmosphere upon spraying. Accordingly, such bounce back or overspray may result in wasted product and/or possible product inhalation risks to the consumers.

Thus, the need remains for a sprayable cleaning composition that provides good cleaning, in particular good cleaning of soils and/or grease removal. The need also exists for a sprayable cleaning composition with minimal negatives associated with the bounce back of the product and/or product overspray.

SUMMARY OF THE INVENTION

According to a first aspect of the invention, there is a provided a sprayable cleaning composition. The composition is suitable for the cleaning of any kind of surfaces but preferably the composition is a hand dishwashing cleaning composition, preferably in liquid form. The composition is suitable for spraying and is preferably a foaming composition. The sprayable cleaning composition is substantially non-irritating and/or non-stinging to the consumers when sprayed for use during the dishwashing process.

In another aspect, the present invention relates to a method of cleaning soiled dishware comprising the steps of:

a) optionally pre-wetting the soiled dishware;
b) spraying a cleaning composition of the invention onto the soiled dishware;
c) optionally adding water to the soiled dishware for a period of time, preferably for a period of from 1 second to 30 seconds;
d) optionally scrubbing the dishware; and
e) rinsing the dishware;

preferably the method is for the removal of cooked-, baked- or burnt-on soils, preferably grease soils, from soiled dishware.

In yet another aspect, the present invention relates to a cleaning product comprising a spray dispenser and a sprayable cleaning composition of the invention wherein the composition is housed in the spray dispenser.

In yet another aspect, the present invention relates to the use of a sprayable cleaning composition of the invention for the generation of a substantially non-irritating and/or non-stinging composition when the composition is sprayed.

One aim of the present invention is to provide a sprayable cleaning composition of the invention which can exhibit good cleaning, in particular good cleaning of light and/or tough soils, and/or grease removal. Another aim of the present invention is to not only provide good cleaning but also fast cleaning, preferably requiring reduced scrubbing effort by the consumer. Thus, the composition of the invention is especially suitable for cleaning dishware under the tap.

Another aim of the present invention is to provide such a sprayable cleaning composition of the invention which can exhibit good sudsing profile, in particular fast suds volume and/or long lasting suds, preferably over the entire dishwashing process.

Another aim of the present invention is to provide such a sprayable cleaning composition that should be easy to spray and easy to rinse off as well. Preferably, the composition of the invention exhibits good phase stability that is acceptable to the consumers.

These and other features, aspects and advantages of the present invention will become evident to those skilled in the art from the detailed description which follows.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (polyethylene, polypropylene, polystyrene, etc.) and wood.

The term "grease" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "spray dispenser" as used herein means a container comprising a housing to accommodate the composition and means to spray the composition. The preferred spraying means being a trigger spray. Preferably, the composition foams when it is sprayed since foaming is a property that consumers associate with effective cleaning performance.

The term "stinging" as used herein means the burning or stinging sensation on the skin, or in the eyes, nose or throat resulting from the user coming in contact with a sprayed or atomized cleaning composition.

The term "substantially non-irritating" as used herein refers to a cleaning composition that does not induce significant itching sensation on the skin, or in the eyes, nose or throat of the user upon contact with a sprayed or atomized composition. For example, the term refers to cleaning compositions that are relatively non-lacrimating (i.e., non-tearing, tear-free).

The term "substantially non-stinging" as used herein refers to a cleaning composition that will not result in a significant stinging sensation by the user upon contact with a sprayed or atomized composition, and can be characterized by having a stinging potential value of maximum 2, preferably maximum 1, as determined by the method described herein. The term "substantially reduce or prevent" as used herein means that the components of the cleaning composition (partially) mitigate, e.g. reduce the stinging sensation on the skin, or in the eyes, nose or throat of the user.

The term "sudsing profile" as used herein refers to the properties of a sprayable cleaning composition relating to suds character during the dishwashing process. For example, the sudsing profile of a composition includes but is not limited to the suds volume generated upon application of the composition on the soiled dishware, and the retention of the suds during the dishwashing process. Preferably, the spraying cleaning composition provides high sudsing and/or sustained suds.

It is understood that the test methods that are disclosed in the Test Methods Section of the present application must be used to determine the respective values of the parameters of Applicants' inventions as described and claimed herein.

In all aspects of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Composition

The Applicants have surprisingly discovered a new way of formulating sprayable cleaning compositions to provide good cleaning, including good cleaning of light and/or tough soils, and/or grease removal, particularly suitable when spraying the composition to clean dishware. The Applicants have discovered that sprayable cleaning composition containing glycol ether solvent causes irritation and/or stinging to the consumers from product bounce back from surfaces when sprayed and/or product overspray. The problem occurs when the glycol ether solvent achieves a critical mass and associates to form a solvation sphere which can then irritate and/or sting the skin, eyes, nose or throat of the consumers. Without wishing to be bound by theory, it is believed that the introduction of the non-ionic surfactant according to the invention breaks up these glycol ether solvation spheres, reducing the stinging risk of a sprayable composition comprising such glycol ether accordingly. Furthermore, the glycol ether has also been found to negatively impact the physical stability profile (i.e., phase splitting upon storage) of the cleaning composition. Addition of the non-ionic surfactant according to the invention has been found to also improve the physical stability profile of compositions comprising glycol ether solvents, likely again due to interrupting the glycol ether solvation spheres formed inside the composition.

Specifically, in one aspect, the composition of the invention comprises:

i) from 2% to 15%, preferably from 5% to 15%, more preferably from 7% to 12% by weight of the composition of a surfactant system, wherein the surfactant system comprises an anionic surfactant and a co-surfactant, wherein the co-surfactant is selected from the group consisting of amphoteric surfactant, zwitterionic surfactant and mixtures thereof, preferably an anionic surfactant and an amphoteric surfactant, more preferably an alkyl ethoxylated sulfate anionic surfactant and an amine oxide surfactant, preferably the alkyl ethoxylated sulfate anionic surfactant has an average degree of ethoxylation of from 2 to 5;

ii) from 1% to 15%, preferably from 1.5% to 10%, more preferably from 2% to 8%, most preferably 3% to 7% by weight of the composition of a non-ionic surfactant, wherein the non-ionic surfactant is a C6 alcohol ethoxylate surfactant, preferably comprising on average from 1 to 10 EO, preferably 3 to 8 EO, preferably 4 to 6 EO, most preferably 5 EO; and iii) a glycol ether solvent, preferably a glycol ether solvent selected from the group consisting of glycol ethers of:

a) Formula (I): $R^1O(R^2O)_mR^3$, wherein $R^1$ is a linear or branched C4, C5 or C6 alkyl or a substituted or unsubstituted phenyl; $R^2$ is ethyl or isopropyl; $R^3$ is hydrogen or methyl; and m is 1, 2 or 3, preferably 1 or 2;

b) Formula (II): $R^4O(R^5O)_nR^6$, wherein $R^4$ is n-propyl or isopropyl; $R^5$ is isopropyl; $R^6$ is hydrogen or methyl; and n is 1, 2 or 3, preferably 1 or 2;

c) Formula (III): $R^7O(R^8O)_pR^9$, wherein $R^7$ is methyl or ethyl; $R^8$ is ethyl or isopropyl; $R^9$ is hydrogen or methyl, preferably hydrogen; and p is 1, 2 or 3, preferably 1 or 2;

d) Formula (IV): $R^{10}O(R^{11}O)_qR^{12}$, wherein $R^{19}$ is n-propyl or isopropyl, preferably n-propyl; $R^{11}$ is ethyl; $R^{12}$ is hydrogen or methyl, preferably hydrogen; and q is 1, 2 or 3, preferably 1 or 2; and e) mixtures thereof, preferably Formula (I), Formula (II) and mixtures thereof, preferably Formula (I) and mixtures thereof;

wherein the surfactant system and the glycol ether solvent are in a weight ratio of from 5:1 to 1:5, preferably from 5:1 to 1:1, more preferably from 3:1 to 1:1.

Furthermore, the composition of the invention provides good cleaning, including cleaning of though food soils such as cooked-, baked- and burnt-on soils and good cleaning of light oily soils. The composition of the invention not only provides outstanding cleaning but also very fast cleaning, requiring reduced scrubbing effort by the consumer. Thus, the composition of the invention is especially suitable for cleaning dishware under the tap. When the dishware is only lightly soiled the composition of the invention provides very good cleaning with reduced scrubbing or in the absence of scrubbing. The dishware can be cleaned by simply spraying the composition followed by a rinse with water, optionally aided by a low force wiping action. In the case of heavily soiled dishware the composition of the invention is very good to facilitate the removal of the soil when the composition is used to pre-treat the dishware. Pre-treatment usually involves leaving the soiled dishware with the neat composition.

Compositions having the claimed level of surfactant system and the claimed weight ratio of surfactant system to glycol ether solvent when sprayed provide good coverage on the dishware with minimum over spray, thereby avoiding wasting product or the risk of inhalation.

Compositions having a surfactant system comprising an anionic surfactant and a co-surfactant have been found to be very good from a cleaning and sudsing viewpoint. They have also been found very good from a spray pattern view point. The presence of small droplets (and therefore the risk of inhalation) is minimized when the surfactant system of the composition of the invention contains anionic surfactant. By co-surfactant is herein meant a surfactant that is present in the composition in an amount lower than the main surfactant. By main surfactant is herein meant the surfactant that is present in the composition in the highest amount. The surfactant system seems to help with the reduction of the irritation and/or stinging aspects of the composition. The sprayed product generated when spraying the composition of the invention are strong enough for effective grease cleaning but at the same time the bounce back from surfaces and/or product overspray when spraying do not irritate/sting the consumers. The surfactant system also seems to help with the cleaning and/or foam generation. The suds generated when spraying the composition of the invention are strong enough to withstand the impact force when the foam contact the article to be washed but at the same time the composition is easy to rinse.

Preferably, the anionic surfactant is an alkyl ethoxylated sulfate anionic surfactant. It has been found that alkyl ethoxylated sulfate anionic surfactant with an average degree of ethoxylation from 2 to 5, preferably 3, performs better in terms of cleaning and/or speed of cleaning than other ethoxylated alkyl sulfate anionic surfactants with a lower degree of ethoxylation. When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree}=(x1*\text{alkoxylation degree of surfactant } 1+x2*\text{alkoxylation degree of surfactant } 2+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol } 1+x2*\text{wt \% branched alcohol 2 in alcohol } 2+\ldots)/(x1+x2+\ldots)]*100$$

wherein x1, x2, are the weight in grams of each alcohol in the total alcohol mixture of the alcohols which were used as starting material for the anionic surfactant for the detergent of the invention.

In the weight average branching degree calculation, the weight of anionic surfactant components not having branched groups should also be included. When the surfactant system comprises a branched anionic surfactant, the surfactant system comprises at least 50%, more preferably at least 60% and preferably at least 70% of branched anionic surfactant by weight of the surfactant system, more preferably the branched anionic surfactant comprises more than 50% by weight thereof of an alkyl ethoxylated sulfate having an average ethoxylation degree of from 2 to 5 and preferably a level of branching of from 5% to 40%.

Suitable sulfate surfactants for use herein include water-soluble salts of C8-C18 alkyl, preferably C8-C18 alkyl comprising more than 50% by weight of the C8 to C18 alkyl of C12 to C14 alkyl or hydroxyalkyl, sulfate and/or ether sulfate. Suitable counterions include alkali metal cation earth alkali metal cation, alkanolammonium or ammonium or substituted ammonium, but preferably sodium.

The sulfate surfactants may be selected from C8-C18 alkyl alkoxy sulfates (AExS) wherein preferably x is from 1-30 in which the alkoxy group could be selected from ethoxy, propoxy, butoxy or even higher alkoxy groups and mixtures thereof. Especially preferred for use herein is alkyl ethoxy sulfate with an average alkyl carbon chain length of C12 to C14 and an average degree of ethoxylation from 2 to 5, preferably 3.

Alkyl alkoxy sulfates are commercially available with a variety of chain lengths, ethoxylation and branching degrees. Commercially available sulfates include, those based on Neodol alcohols ex the Shell company, Lial—Isalchem and Safol ex the Sasol company, natural alcohols ex The Procter & Gamble Chemicals company.

Preferably, the co-surfactant is selected from the group consisting of amphoteric surfactant, zwitterionic surfactant and mixtures thereof. Preferably the amphoteric surfactant is an amine oxide. Preferably, the amine oxide is selected from the group consisting of linear or branched alkyl amine oxide, linear or branched alkyl amidopropyl amine oxide, and mixtures thereof, preferably linear alkyl dimethyl amine oxide, more preferably linear C10 alkyl dimethyl amine oxide, linear C12-C14 alkyl dimethyl amine oxides and mixtures thereof, most preferably linear C12-C14 alkyl dimethyl amine oxide.

Other suitable co-surfactants include zwitterionic surfactants, preferably betaines, such as alkyl betaines, alkylamidobetaine, amidazoliniumbetaine, sulfobetaine (INCI Sultaines) as well as the Phosphobetaine and preferably meets Formula (V):

$$R1—[CO—X\ (CH2)n]x—N+(R2)(R3)—(CH2)m—[CH(OH)—CH2]y—Y— \quad (V)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the Formula (Va), the alkyl amido propyl betaine of the Formula (Vb), the Sulfo betaines of the Formula (Vc) and the Amido sulfobetaine of the Formula (Vd);

| | |
|---|---|
| R1—N+(CH3)2—CH2COO— (Va) | R1—CO—NH(CH2)3—N+(CH3)2—CH2COO— (Vb) |
| R1—N+(CH3)2—CH2CH(OH)CH2SO3— (Vc) | R1—CO—NH—(CH2)3—N+(CH3)2—CH2CH(OH)CH2SO3— (Vd) |

in which R1 has the same meaning as in Formula (V). Particularly preferred betaines are the Carbobetaine [wherein Y——COO—], in particular the Carbobetaine of the Formulae (Va) and (Vb), more preferred are the Alkylamidobetaine of the Formula (Vb).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines. A preferred betaine is, for example, Cocoamidopropylbetaine.

The co-surfactant seems to help with the sudsing of the composition of the invention. Particularly good performing compositions of the invention are those in which the anionic surfactant and the co-surfactant are present in a weight ratio of 4:1 to 1:1, preferably in a weight ratio of from 3:1 to 2:1, most preferably in a weight ratio from 2.8:1 to 1.3:1.

The most preferred surfactant system for the detergent composition of the present invention comprises: (1) 4% to 10%, preferably 5% to 8% by weight of the composition of an alkyl ethoxylated sulfate anionic surfactant; (2) 1% to 5%, preferably from 1% to 4% by weight of the composition of a surfactant selected from the group consisting of amphoteric surfactant, zwitterionic surfactant and mixtures thereof, preferably an amine oxide surfactant. It has been found that such surfactant system in combination with the glycol ether of the invention provides excellent cleaning and good foaming profile.

The composition preferably has a surfactant system: glycol ether weight ratio of from 5:1 to 1:5. The term "surfactant system" includes the anionic surfactant and the amphoteric and/or zwitterionic co-surfactant system if present. Compositions having a surfactant system: glycol ether solvent weight ratio lower than 1:5 do not seem to be able to foam and/or tend to phase separate creating physical instability in the product. Compositions having a surfactant system: glycol ether solvent weight ratio higher than 5:1 are difficult to spray and are prone to gelling when in contact with greasy soils in the presence of the low levels of water typically present when the compositions of the invention are used. Gel formation would inhibit the spreading of the composition negatively impairing on the cleaning.

The glycol ether solvent typically is present from 1% to 10%, preferably from 2 to 8%, most preferably from 3% to 7% by weight of the composition. The composition of the invention comprises a glycol ether solvent selected from the group consisting of glycol ethers of: Formula (I); Formula (II); Formula (III); Formula (IV); and mixtures thereof; preferably Formula (I), Formula (II), and mixtures thereof; more preferably Formula (I) and mixtures thereof. It has been found that these glycol ethers help not only with the speed of cleaning of the composition but also with the cleaning, especially greasy soils cleaning. The glycol ether of the product of the invention can boost foaming. This does not seem to happen with glycol ethers having a different formula to Formula (I), Formula (II), Formula (III), Formula (IV) and mixtures thereof.

Preferably, the glycol ether solvent is selected from the group consisting of ethylene glycol monohexyl ether, propylene glycol n-butyl ether, dipropylene glycol n-butyl ether, diethylene glycol monoethyl ether, ethylene glycol monobutyl ether, dipropylene glycol n-propyl ether, propylene glycol methyl ether, dipropylene glycol methyl ether, ethylene glycol mono-n-propyl ether and mixtures thereof, preferably ethylene glycol monohexyl ether, propylene glycol n-butyl ether, dipropylene glycol n-butyl ether, diethylene glycol monoethyl ether, ethylene glycol monobutyl ether, dipropylene glycol n-propyl ether, and mixtures thereof, most preferably ethylene glycol monohexyl ether, propylene glycol n-butyl ether, dipropylene glycol n-butyl ether, diethylene glycol monoethyl ether and mixtures thereof.

Suitable glycol ether solvents can be purchased from The Dow Chemical Company, more particularly from the E-series (ethylene glycol based) Glycol Ethers and the P-series (propylene glycol based) Glycol Ethers line-ups. Suitable glycol ethers include: Hexyl Cellosolve™ Dowanol™ PnB, Dowanol™ DPnB, Butyl Cellosolve™, Dowanol™ DPnP, Dowanol™ PM, Dowanol~ DPM, Propyl Cellosolve™, Carbitol™ and mixtures thereof.

The composition according to the invention also comprises from 1% to 15%, preferably from 1.5% to 10%, more preferably from 2% to 8%, most preferably from 3% to 7% by weight of the composition of a non-ionic surfactant preferably selected from alcohol alkoxylate non-ionic surfactant, preferably alcohol ethoxylate surfactant or mixtures thereof, preferably a low to mid cut alcohol ethoxylate surfactant, more preferably a low cut non-ionic surfactant, more preferably a C6 alcohol ethoxylate surfactant, preferably comprising on average from 1 to 10 EO, preferably from 3 to 8, preferably from 4 to 6, most preferably 5. Low cut alcohol ethoxylate surfactants include alcohol ethoxylate surfactants with an average alkyl carbon chain length of C10 and below. Mid cut alcohol ethoxylate surfactants will comprise an average alkyl carbon chain length of above C10 up to C14. The alkyl chain can be linear or branched and originating from a natural or synthetically derived alcohol. Suitable non-ionic alcohol ethoxylate surfactants include commercially available materials such as Emulan® HE50 or Lutensol® CS6250 (available from BASF).

Preferably, the composition of the invention further comprises from 0.5% to 10%, preferably from 1% to 5%, more preferably from 1.5% to 3% by weight of the composition of a hydrotrope selected from the group consisting of sodium cumene sulphonate, sodium toluene sulphonate, sodium xylene sulfonate and mixtures thereof, preferably sodium cumene sulphonate.

Preferably, the composition of the invention further comprises from 0.01% to 5%, preferably from 0.03% to 3%, more preferably from 0.05% to 1%, most preferably from 0.07% to 0.5% by weight of the composition of a thickening agent, preferably the thickening agent is selected from the group consisting of polyethylene glycol, polyalkylene oxide, polyvinyl alcohol, polysaccharide and mixtures thereof, preferably polysaccharides, preferably xanthan gum. Without wishing to be bound by theory, these thickening agents are believed to further reduce stinging and/or enable stronger clinging of the composition to surfaces, especially to vertically positioned surfaces.

The composition of the invention preferably further comprises a chelant, preferably an aminocarboxylate chelant, more preferably a salt of glutamic-N,N-diacetic acid (GLDA). GLDA (salts and derivatives thereof) is especially preferred according to the invention, with the tetrasodium salt thereof being especially preferred. The aminocarboxylate not only act as a chelant but also contributes to the reserve alkalinity, this seems to help with the cleaning of cooked-, baked- and burnt-on soils. Preferably, the chelant is present at a level of from 0.1% to 10%, preferably from 0.2% to 5%, more preferably from 0.2% to 3%, most preferably from 0.5% to 1.5% by weight of the composition.

The composition of the invention preferably further comprises a builder, preferably citrate. The builder, when present, is preferably present at the level of from 0.01% to 5%, more preferably from 0.05% to 1% by weight of the composition. The builder also contributes to the reserve alkalinity.

The composition of the invention preferably further comprises a bicarbonate. The bicarbonate, when present, is preferably present at the level of from 0.01% to 5%, more preferably from 0.025% to 1%, most preferably from 0.05% to 0.5% by weight of the composition.

The composition of the invention preferably further comprises an alkanol amine, preferably monoethanol amine. The alkanol amine, when present, is preferably present at the level of from 0.1% to 10%, more preferably from 0.2% to 5%, most preferably 0.3% to 1% by weight of the composition.

The composition of the invention preferably further comprises from 0.01% to 5% by weight of the composition of an organic solvent selected from the group consisting of C2-C4 alcohols, C2-C4 polyols, poly alkylene glycol and mixtures thereof.

The composition of the invention can be Newtonian or non-Newtonian. When Newtonian the composition preferably has a viscosity of from 1 mPa·s to 50 mPa·s, preferably from 1 mPa·s to 20 mPa·s, more preferably from 1 mPa·s to 10 mPa·s at 20° C., as measured using the method defined herein. Alternatively, the composition of the invention can be a shear thinning fluid. This is important to allow the composition to be easily sprayed. The viscosity of the composition of the invention should also help the sprayed fluid stay on surfaces, especially vertical surfaces, to provide cleaning and at the same time be easy to rinse. Especially suitable are compositions having a high shear viscosity at 20° C. of from 1 mPa·s to 50 mPa·s, preferably from 1 mPa·s to 20 mPa·s, preferably of from 5 mPa·s to 15 mPa·s at 1,000 $s^{-1}$, and a low shear viscosity at 20° C. of from 100 mPa·s to 1000 mPa·s, preferably from 200 mPa·s to 500 mPa·s at 0.1 $s^{-1}$, as measured using the method defined herein.

Preferably, the composition of the invention has a neat pH range of from 8 to 13, preferably from 10 to 11.5, at 20° C. Preferably, the composition has a reserve alkalinity of from 0.1 to 0.3. Reserved alkalinity is defined as the grams of NaOH per 100 g of composition required to titrate the test composition at pH 10 to come to the test composition pH. The pH and the reserve alkalinity can contribute to the cleaning of tough food soils.

The composition of the present invention preferably comprises water. The water may be added to the composition directly or may be brought into the composition with raw materials. In any event, the total water content of the composition herein may comprise from 30% to 95%, preferably from 40% to 90%, more preferably from 50% to 85% by weight of the total composition.

The composition herein may optionally comprise a number of other adjunct ingredients such as conditioning polymers, cleaning polymers, surface modifying polymers, soil flocculating polymers, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The present invention also relates to a cleaning product, preferably a hand dishwashing cleaning product, comprising a spray dispenser and a sprayable cleaning composition, wherein the composition is housed in the spray dispenser. The spray dispenser comprises a housing to accommodate the composition of the invention and spraying means. Suitable spray dispensers include hand pump (sometimes referred to as "trigger") devices, pressurized can devices, electrostatic spray devices, etc. Preferably the spray dispenser is non-solvent propellant pressurized and the spray means are of the trigger dispensing type. The sprayable cleaning composition comprises a surfactant system, a non-ionic surfactant and a specific glycol ether solvent. The product of the invention simplifies the cleaning task, in particular the manual dishwashing task, by making the task easier and faster. The product of the invention is particularly suitable for the manual cleaning of dishware. Preferably, the cleaning product of the invention comprises a sprayable cleaning composition wherein the composition is substantially non-irritating and/or non-stinging to the skin, eyes, nose, throat or combinations thereof of a consumer when sprayed from the spray dispenser.

Method of Cleaning

According to another aspect of the invention, there is provided a method of cleaning soiled dishware using the product according to any of the preceding claims comprising the steps of:

a) optionally pre-wetting the soiled dishware
b) spraying a cleaning composition according to the invention onto the soiled dishware;
c) optionally adding water to the soiled dishware for a period of time, preferably for a period of from 1 second to 30 seconds;
d) optionally scrubbing the dishware; and
e) rinsing the dishware.

The method of the invention allows for faster and easier cleaning of dishware under running tap, especially when the dishware is lightly soiled. When the dishware is soiled with tough food soils such as cooked-, baked- or burnt-on soils the method of the invention facilitates the cleaning when the soiled dishware is soaked with the product of the invention in neat form or diluted in water.

Test Methods

The following assays set forth must be used in order that the invention described and claimed herein may be more fully understood.

Test Method 1: Reserve Alkalinity

The reserve alkalinity for a solution is determined in the following manner A pH meter (for example An Orion® Model 720A from Thermo Scientific) with a Ag/AgCl electrode (for example an Orion sure flow Electrode model 9172BN) is calibrated using standardized pH 7 and pH 10 buffers. A 100 g of a 10% solution in distilled water at 20° C. of the composition to be tested is prepared. The pH of the 10% solution is measured and the 100 g solution is titrated down to pH 10 using a standardized solution of 0.1 N of HCl. The volume of 0.1 N HCl required is recorded in mL. The reserve alkalinity is calculated as follows:

Reserve Alkalinity=mL 0.1N HCl×0.1 (equivalent/liter)×Equivalent weight NaOH (g/equivalent)×10

Test Method 2: Viscosity

The rheology profile is measured using a "TA instruments DHR1" rheometer, with a flat steel Peltier plate and a 60 mm, 2026° cone plate geometry (TA instruments, serial number: SN960912). The flow curve procedure includes a conditioning step and a flow sweep step at 20° C. The conditioning step comprises a 10 seconds soaking step at 20° C., followed by a 10 seconds pre-shear step at 10 $s^{-1}$ at 20° C., followed by a 30 seconds zero shear equilibration step 20° C. The flow sweep step comprises a logarithmical shear rate increase from 0.01 $s^{-1}$ to 3,000 $s^{-1}$ at 20° C., with a 10 points per decade acquisition rate, a maximum equilibration time of 200 seconds, a sample period of 15 seconds and a tolerance of 3%.

When measuring shear thinning product compositions the high shear viscosity is defined at a shear rate of 1,000 $s^{-1}$, and the low shear viscosity at a shear rate of 0.1 $s^{-1}$. For Newtonian product compositions the shear rate at 1,000 $s^{-1}$ is recorded.

Test Method 3: Stinging Test

The objective of the Stinging Test is to compare the level of stinging sensation and/or irritant sensations in subjects produced by test composition(s) vs. comparative composition(s) after spray application. Test composition is sprayed against a vertical wall of a clean dried stainless steel sink and its stinging performance is consequently assessed by panelists selected from individuals who are trained to evaluate stinging performance according to the scales below. The test is repeated with the comparative composition. The test is conducted in a standard conditioned lab at approximately 20° C. and approximately 40% humidity.

Spray Bottle Preparation: Any type of spray bottle can be used for the stinging assessment (e.g., Flairosol® type spray bottle commercially available from AFA Dispensing Group (the Netherlands)). Although, the same type of spray bottle should be used to conduct the testing with the test and comparative compositions.

Prime the nozzle of the spray bottle before the test by spraying the test composition 5 times in a separate sink positioned at least 5 meters away from the test sink. The priming action is to ensure there is no air nor liquid contamination in the spraying nozzle. Also, this priming action helps to verify the spray nozzle is not blocked and that the spray pattern is relatively consistent and as expected.

Stinging Test: Hold the spray bottle at about 15 cm from the vertical wall of a test sink (measuring 40 cm×40 cm footprint, 24 cm height) in a vertical position such that the reservoir remains in a vertical position so that all of the test composition can be sprayed using the spray mechanism. Spray the test composition 8 times at a spraying frequency of 1 spray per second and in a manner such that the sprays land sequentially on top of each other. Ensure all sprayed composition hits the vertical wall. After the last spray, the panelist immediately brings his/her nose to about 5 cm from the sink wall, near the top of the sprayed area, and inhales normally for 5 seconds. Panelist returns to the upright position and immediately assesses the sensations/smells detected according to the classification scale below. The sink is rinsed excessively with water to ensure that no remnant perfumes or chemistries remains prior to testing a new composition. Leave at least 15 minutes between different test compositions and avoid testing more than 4 compositions within a period of half a day, in order to prevent saturation of the nose. Repeat above steps with the comparative composition.

The irritant and/or stinging sensation is assessed by the panelist based on the following scale:

TABLE 1

| Classification | |
|---|---|
| 0 | Feel/smell nothing<br>No itching sensation in the nose and/or throat and no tearing in the eyes |
| 1 | Feel/smell nothing except normal perfume/composition smell<br>No itching sensation in the nose and/or throat and no tearing in the eyes |
| 2 | Start feeling some tingling in the nose that disappears very fast<br>Might also start feeling mild itching sensation in the nose and/or throat and/or tearing in the eyes |
| 3 | Feel mild tingling in the nose and throat<br>Might also feel mild itching sensation in the nose and/or throat and/or tearing in the eyes |
| 4 | Feel a need to cough and unpleasant feeling in nose/throat for longer duration<br>Might also feel strong itching sensation in the nose and/or throat and/or tearing in the eyes |

EXAMPLES

The following examples are provided to further illustrate the present invention and are not to be construed as limitations of the present invention, as many variations of the present invention are possible without departing from its spirit or scope.

Example 1: Stinging/Irritation and Stability Assessment of Glycol Ether Comprising Cleaning Compositions in the Presence or Absence of a Non-Ionic Surfactant The following cleaning compositions are produced through standard mixing of the components described in Table 2. Different glycol ethers, as listed in Table 3, are inserted into the inventive and comparative compositions. Inventive Compositions 1 to 8 are non-limiting examples of cleaning compositions according to the present invention, which are made with the varying glycol ethers and a non-ionic surfactant. In parallel, Comparative Compositions 1 to 8 are prepared by replacing the non-ionic surfactant by the same amount of deionized water.

The resultant compositions including the Inventive Compositions (comprising non-ionic surfactant according to the invention) and Comparative Compositions (not comprising non-ionic surfactant according to the invention) are assessed according to the Stinging Test method as described herein. The results of the stinging test are summarized in Table 3.

The resultant compositions are also assessed for their physical stability (i.e., absence versus presence of phase splitting) when the compositions are subjected to stressed temperature. The compositions are stored for 2 weeks at 50° C. and a visual assessment of their physical stability is performed at the end of the test period. A composition is assessed to be "stable" if one homogeneous liquid phase, i.e. no apparent phase separation, is visually observed. A composition is assessed to be "not stable" if a phase separation can be visually observed. The results of the physical stability test are also summarized in Table 3 below.

TABLE 2

Inventive and Comparative Compositions

| Ingredients | Inventive Composition [1] (with non-ionic surfactant) | Comparative Composition [1] (nil non-ionic surfactant) |
|---|---|---|
| C12-C13 AE3S [6] | 6.5% | 6.5% |
| C12-14 dimethyl amine oxide | 2.5% | 2.5% |
| Emulan ® HE50 [2] | 5% | — |
| Glycol ether [3] | 5% | 5% |
| monoethanolamine | 0.5% | 0.5% |
| GLDA chelant [4] | 1% | 1% |
| ethanol | 0.3% | 0.3% |
| PPG 2000 [5] | 0.05% | 0.05% |
| Sodium bicarbonate | 0.1% | 0.1% |
| Xanthan Gum | — | 0.1% |
| Water and minors (preservatives, dyes, perfume at 0.25%) | Balance to 100% | Balance to 100% |
| pH | 11.2 | 11.2 |

[1] wt % active relative to the total weight of the composition.
[2] Emulan ® HE50 is linear C6 alkyl ethoxylated alcohol (EO5) and commercially available from BASF.
[3] Can be any one of the glycol ethers in Table 3.
[4] Commercially available under tradename Dissolvine ® 47S from Akzo Nobel.
[5] PolyPropylene glycol (molecular weight 2000).
[6] AE3S is a C12-C13 alkyl ethoxylate sulfate, with an average degree of ethoxylation of 3.

Results: The table below shows the respective stinging/irritation performance and physical stability of the Inventive Compositions and Comparative Compositions. The results clearly show substantially reduced stinging/irritation and improved physical stability for the Inventive Compositions comprising the non-ionic surfactant according to the invention, compared to the Comparative Compositions not comprising the non-ionic surfactant according to the invention (compositions 1 to 3). Addition of the non-ionic surfactant according to the invention also does not negatively impact formulations with already acceptable stinging and physical stability profile (compositions 4 and 5).

TABLE 3

Stinging/Irritation Performance and Physical Stability

| | Inventive Composition | | | Comparative Composition | | |
|---|---|---|---|---|---|---|
| Glycol Ether | | Stinging/ Irritation | Physical Stability | | Stinging/ Irritation | Physical Stability |
| Dowanol ™ DPnB | Inventive Comp. 1 | 1 | Stable | Comparative Comp. 1 | 3 | Not stable |
| Hexyl Cellosolve ™ | Inventive Comp. 2 | 1 | Stable | Comparative Comp. 2 | 1 | Not Stable |
| Carbitol ™ | Inventive Comp. 3 | 1 | Stable | Comparative Comp. 3 | 2 | Stable |
| Dowanol ™ DPnP | Inventive Comp. 4 | 1 | Stable | Comparative Comp. 4 | 1 | Stable |

TABLE 3-continued

| Stinging/Irritation Performance and Physical Stability | | | | | | |
|---|---|---|---|---|---|---|
| | Inventive Composition | | | Comparative Composition | | |
| Glycol Ether | | Stinging/ Irritation | Physical Stability | | Stinging/ Irritation | Physical Stability |
| Propyl Cellosolve ™ | Inventive Comp. 5 | 1 | Stable | Comparative Comp. 5 | 1 | Stable |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sprayable cleaning composition comprising:

i) from about 2% to about 15% by weight of the composition of a surfactant system, wherein the surfactant system comprises an alkyl ethoxylated sulfate anionic surfactant and an amine oxide surfactant, wherein the alkyl ethoxylated sulfate anionic surfactant and the amine oxide surfactant are present in a ratio of from about 4:1 to about 1:1;

ii) from about 1% to about 15% by weight of the composition of a non-ionic surfactant, wherein the non-ionic surfactant comprises a C6-C8 alcohol ethoxylate surfactant comprising on average from about 3 to about 8 EO; and iii) from 1% to 10% by weight of the composition of the glycol ether solvent selected from the group consisting of glycol ethers of:

a) Formula (I): $R^1O(R^2O)_mR^3$, wherein $R^1$ is a linear or branched C4, C5 or C6 alkyl or a substituted or unsubstituted phenyl; $R^2$ is ethyl or isopropyl; $R^3$ is hydrogen or methyl; and m is 1, 2 or 3;

b) Formula (II): $R^4O(R^5O)R^6$, wherein $R^4$ is n-propyl or isopropyl; $R^5$ is isopropyl; $R^6$ is hydrogen or methyl; and n is 1, 2 or 3;

c) Formula (III): $R^7O(R^8O)_pR^9$, wherein $R^7$ is methyl or ethyl, $R^8$ is ethyl or isopropyl; $R^9$ is hydrogen or methyl; and p is 1, 2 or 3;

d) Formula (IV): $R^{10}O(R^{11}O)_qR^{12}$, wherein $R^{10}$ is n-propyl or isopropyl; $R^{11}$ is ethyl; $R^{12}$ is hydrogen or methyl; and $_q$ is 1, 2 or 3; and e) mixtures thereof;

wherein the surfactant system and the glycol ether solvent are in a weight ratio of from about 5:1 to about 1:5 and wherein the composition is substantially non-irritating and/or non-stinging to the skin, eyes, nose, throat or combinations thereof of a consumer when sprayed.

2. The composition according to claim 1 wherein i) the alkyl ethoxylated sulfate anionic surfactant has an average degree of ethoxylation of from about 2 to about 5.

3. The composition according to claim 1 wherein the amine oxide surfactant is selected from the group consisting of linear or branched alkyl amine oxide, linear or branched alkyl amidopropyl amine oxide, and mixtures thereof.

4. The composition according to claim 1 wherein the glycol ether solvent is selected from the group consisting of ethylene glycol monohexyl ether, propylene glycol n-butyl ether, dipropylene glycol n-butyl ether, diethylene glycol monoethyl ether, ethylene glycol monobutyl ether, dipropylene glycol n-propyl ether, propylene glycol methyl ether, dipropylene glycol methyl ether, ethylene glycol mono-n-propyl ether and mixtures thereof.

5. The composition according to claim 1 wherein the composition further comprises from about 0.5% to about 10% by weight of the composition of a hydrotrope selected from the group consisting of sodium cumene sulphonate, sodium toluene sulphonate, sodium xylene sulfonate and mixtures thereof.

6. The composition according to claim 1 wherein the composition further comprises from 0.01% to 5% by weight of the composition of a thickening agent, selected from the group consisting of polyethylene glycol, polyalkylene oxide, polyvinyl alcohol, polysaccharide and mixtures thereof.

7. The composition according to claim 1 wherein the composition further comprises a chelant.

8. The composition according to claim 1 wherein the composition further comprises a builder.

9. The composition according to claim 1 wherein the composition further comprises a bicarbonate.

10. The composition according to claim 1 wherein the composition further comprises an alkanol amine.

11. The composition according to claim 1 further comprising from about 0.01% to about 5% by weight of the composition of an organic solvent selected from the group consisting of C2-C4 alcohols, C2-C4 polyols, poly alkylene glycol and mixtures thereof.

12. The composition according to claim 1 wherein the composition has a Newtonian viscosity of from about 1 mPa·s to about 50 mPa·s, at about 20° C.

13. The composition according to claim 1 wherein the composition has a shear thinning rheology profile having a high shear viscosity at about 1,000 $s^{-1}$ of from about 1 mPa·s to about 50 mPa·at about 20° C., and a low shear viscosity at about 0.01 $s^{-1}$ of from about 100 mPa·s to about 1000 mPa·s at about 20° C.

14. The composition according to claim 1 wherein the composition has a neat pH range of from about 8 to about 13 at about 20° C.

15. The composition according to claim 1 wherein the composition has a reserve alkalinity of from about 0.1 to about 0.3, expressed as g NaOH/100 mL of composition at a pH of about 10.

16. A cleaning product comprising a spray dispenser and a sprayable cleaning composition according to claim 1, wherein the composition is housed in the spray dispenser.

17. A method of cleaning soiled dishware comprising the steps of:

a) optionally pre-wetting the soiled dishware;

b) spraying a cleaning composition according to claim 1 onto the soiled dishware;

c) optionally adding water to the soiled dishware for a period of time;

d) optionally scrubbing the dishware; and e) rinsing the dishware.

18. The composition according to claim 1 wherein the surfactant system and the glycol ether solvent are in a weight ratio of from about 5:1 to about 1:1.

* * * * *